United States Patent [19]

Gray et al.

[11] 4,219,084

[45] Aug. 26, 1980

[54] FIRE EXTINGUISHING APPARATUS HAVING A SLIDABLE MASS FOR A PENETRATOR NOZZLE

[76] Inventors: Robert A. Frosch, Administrator of the National Aeronautics and Space Administration, with respect to an invention of Norris C. Gray, Melbourne; Robert M. Senseny, Titusville; Philip N. Bolton, Cape Canaveral, all of Fla.

[21] Appl. No.: 897,840

[22] Filed: Apr. 19, 1978

[51] Int. Cl.[3] ..... A62C 35/12

[52] U.S. Cl. ..... 169/70; 169/62

[58] Field of Search ..... 169/62, 70; 239/271, 239/272; 173/90, 91; 227/147; 30/164.6

[56] References Cited

U.S. PATENT DOCUMENTS

| | | | |
|---|---|---|---|
| 2,235,915 | 3/1941 | Bohan | 169/70 |
| 2,548,621 | 4/1951 | Rutledge | 239/271 |
| 2,756,829 | 7/1956 | Phillips | 169/62 |
| 2,857,005 | 10/1958 | Medlock | 169/62 |
| 2,993,650 | 7/1961 | Badberg | 239/271 |
| 3,381,763 | 5/1968 | Matson | 173/91 |
| 4,106,701 | 8/1978 | Siefkin | 239/271 |

*Primary Examiner*—Robert J. Spar
*Assistant Examiner*—Fred A. Silverberg
*Attorney, Agent, or Firm*—James O. Harrell; John R. Manning

[57] ABSTRACT

A fire extinguishing apparatus delivering an extinguishing agent through a barrier surrounding a structure into the interior thereof. The apparatus includes an elongated tubular nozzle body which has a pointed penetrating head carried on one end of the tubular body. A source of extinguishing agent is coupled to the opposite end of the tubular body and is fed therethrough and passes through passages adjacent the head for delivering the extinguishing agent to the interior of the structure. A slidable mass is carried on the tubular body on a remote end of the tubular body from the penetrating head. By manipulating the slidable mass and bringing such in contact with an abutment the force imparted to the tubular body causes the head to penetrate the structure.

1 Claim, 3 Drawing Figures

FIRE EXTINGUISHING APPARATUS HAVING A SLIDABLE MASS FOR A PENETRATOR NOZZLE

ORIGIN OF THE INVENTION

The invention described herein was made in performance of work under a NASA Contract and is subject to the provisions of Section 305 of the National Aeronautics and Space Act of 1968, Public Law 85-568 (72 Stat. 435, 402 USCP 2457).

BACKGROUND OF THE INVENTION

The present invention relates to a fire extinguishing apparatus to penetrate barriers and more particularly to a nozzle which can be manipulated manually to apply a force to a penetrating head for penetrating a barrier such as the skin of an aircraft or spacecraft for dispensing a fire extinguishing agent therein.

Bayonet type nozzles for use for fire extinguishing equipment have been utilized in the past and in one particular device the nozzle has a pointed head which is manually forced through the skin or barrier of the structure that it is to penetrate. Oftentimes the strength of the barrier is sufficient to prevent the manually forcing of the penetrating nozzle therethrough. In one attempt to overcome this problem, explosively operated piercing applicators have been utilized. This type of applicator is not practical for use in a possibly explosive atmosphere such as would often be encountered in a fire of an aircraft or spacecraft.

Sledge hammer operated penetrating fire extinguishing nozzles have been proposed and one such device is illustrated in U.S. Pat. No. 2,548,621. In this particular device a sledge hammer is used for driving the nozzle into the object. This is not practical in many applications in that it requires one person to hold the penetrating nozzle while another swings the sledge hammer.

Other types of penetrating fire extinguishers are disclosed in U.S. Pat. Nos. 2,756,829, 2,967,570 and 2,235,915.

SUMMARY OF THE INVENTION

The invention pertains to a fire extinguishing apparatus for delivering an extinguishing agent from a remote source through a barrier surrounding a structure into the interior of the barrier. The apparatus includes an elongated tubular nozzle body which has a pointed penetrating head carried adjacent one end thereof. Passages extend through the tubular body adjacent the head for communicating with the interior bore of the tubular body. A coupling is provided on the remote end of the tubular body so that a hose or the like can be coupled thereto for supplying the extinguishing agent to the nozzle.

A slidable mass is carried on the tubular body for aiding in forcing the nozzle through the barrier. The nozzle is normally held by a handle with one hand while the other hand is used for moving the slidable mass forward so as to strike an abutment carried thereon. The force of the mass striking the abutment is transferred through the elongated body to the pointed penetrating head causing the head to penetrate into the interior of the structure.

Accordingly, it is an object of the invention to provide a fire extinguishing apparatus which can be manually manipulated so as to penetrate into the interior of structures.

Another important object of the present invention is to provide a very simple and relatively inexpensive penetrating nozzle that can be operated by a single person.

Still another important object of the present invention is to provide a fire extinguishing apparatus that is relatively safe to use in explosive environments for penetrating the skin of structures such as aircraft or spacecraft skins.

These and other objects and advantages of the invention will become apparent upon reference to the following specification, attendant claims and drawing.

DESCRIPTION OF A PREFERRED EMBODIMENT

Figure 1:
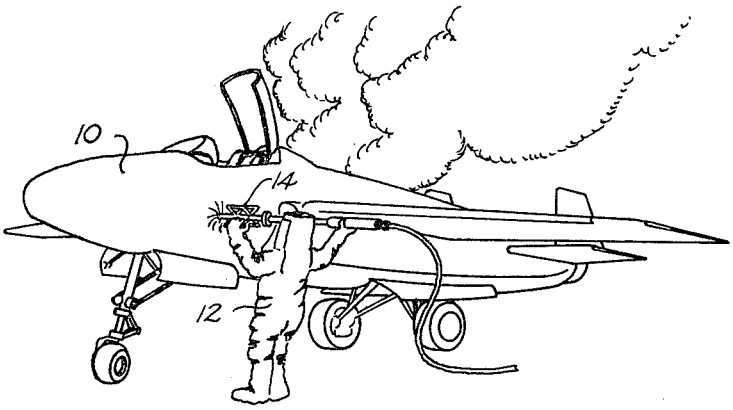
FIG. 1 is a perspective view illustrating a constructed in accordance with the present invention being used to penetrate the skin of an aircarft.

Referring in more detail to FIG. 1 of the drawing, there is illustrated an aircraft 10 in which, if a fire broke out, it is desired to have a penetrating nozzle that will penetrate the skin of the aircraft so as to disperse a fire extinguishing agent therein. The aircraft skin is normally constructed of metal and it normally requires more than a mere pushing force by a fireman or the like of a penetrating nozzle so as to penetrate into the interior thereof. A fireman as illustrated by the reference character 12, is shown holding a penetrating fire extinguishing nozzle 14 in his left hand while manipulating a weight carried thereon with his right hand so as to impart a force to a penetrating head for penetrating into the skin of the aircraft. This type of penetrating nozzle is especially effective to penetrate the relatively thick skin on certain spacecraft, such as the space shuttle orbitor.

Figure 3:
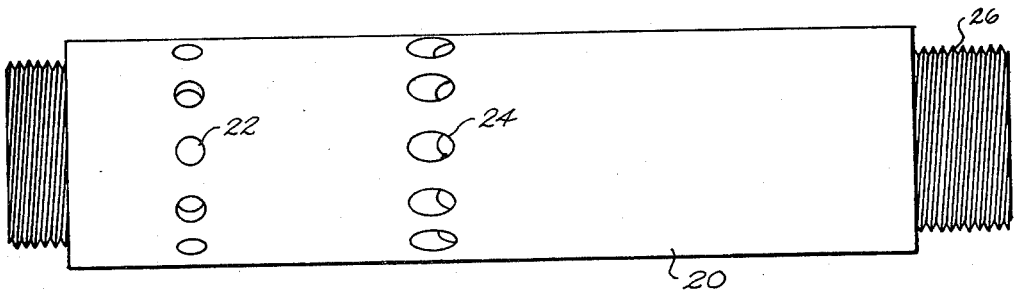
FIG. 3 is an enlarged perspective view illustrating a nozzle head with passages extending therethrough for dispersing the extinguishing agent.

The penetrating nozzle 14 includes an elongated tubular body 16 which may be constructed of any suitable material such as stainless steel. Positioned on one end of the tubular body is a pointed penetrating head 18 that has threads provided on the large end thereof for screwing onto a nozzle head 20. The nozzle head 20, as illustrated in FIG. 3, has circumferentially spaced perpendicularly extending holes 22 provided therein. It also has holes 24 which are cut on a forty-five degree angle for dispersing the extinguishing agent in a predetermined pattern. The other end of the nozzle head 20 has threads 26 provided thereon so that the nozzle head can be threaded on the end of the tubular body 16. It is to be understood that the nozzle head 20 can be readily changed and another type of nozzle head having a different spray pattern substituted therefor.

A fire extinguishing agent can be supplied from any suitable source such as a fire truck, through a hose 28 which is coupled by means of a coupling 30 to the end of the tubular body 16. This permits the extinguishing agent to flow through the hose 28, the tubular body 16, and out of the openings 22 and 24 provided in the nozzle head for extinguishing the fire after the apparatus has been inserted through the skin of the aircraft.

Figure 2:
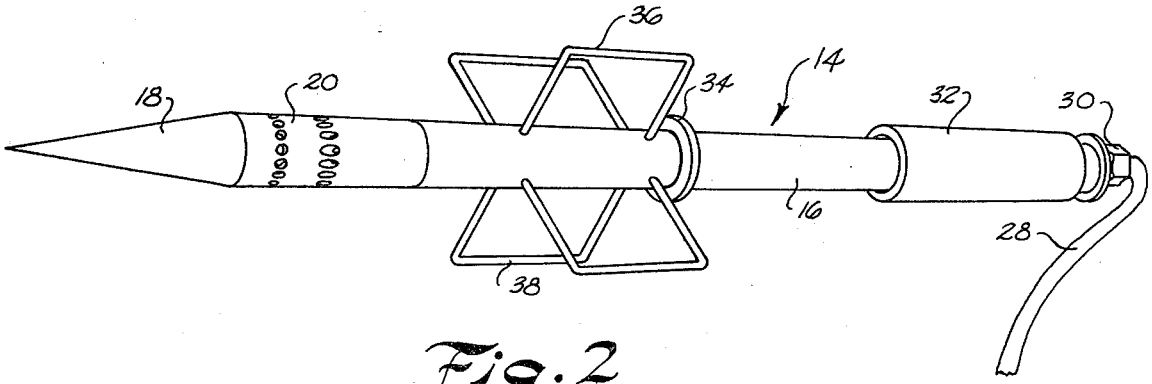
FIG. 2 is an enlarged elevational view of the penetrating nozzle constructed in accordance with the present invention.

In order to aid in forcing the penetrating nozzle through the skin of the aircraft, a slidable mass in the form of a sleeve 32 is carried on the tubular body 61. In the embodiment illustrated in FIG. 2, the slidable mass 32 has a cylindrical bore extending therethrough with inner and outer walls. Lead is inserted between the inner and outer wall for adding weight to the slidable mass 32. An abutment in the form of a disk 34 is secured to the tubular body 16 by any suitable means such as welding. Positioned on the left-hand side of the abutment are two U-shaped handles 36 and 38 which the operator grasps when lifting and positioning the penetrating nozzle.

In operation, when a fire breaks out in a structure such as an aircraft or spacecraft, the operator places the pointed head 18 of the penetrating nozzle flush against the skin of the aircraft by grasping one of the handles 36 or 38 with his left hand. With his right hand he grasps the slidable mass 32 and moves such rapidly to the left. When the mass 32 strikes the abutment 34 the force of the moving mass is transferred through the tubular housing to the pointed penetrating head 18. This causes the head to penetrate the skin of the aircraft. If the penetrating head does not penetrate completely through the aircraft on the first blow, the operator returns the mass to the right and repeats the striking cycle.

After the nozzle has penetrated the skin of the aircraft so that the passages 22 and 24 are within the interior thereof, then a valve is opened on the firefighting equipment permitting the extinguishing agent to flow through the tubular housing into the aircraft.

While a preferred embodiment of the invention has been described using specific terms, such description is for illustrative purposes only, and it is to be understood that changes and variations may be made without departing from the spirit or scope of the following claims.

What is claimed is:

1. A fire extinguishing apparatus for delivering an extinguishing agent from a remote source through a barrier surrounding a structure into the interior thereof comprising:

(a) a single elongated tubular nozzle body;

(b) a pointed penetrating head carried on one end of said tubular nozzle body;

(c) passages extending through said tubular nozzle body adjacent said head communicating with the interior of said tubular nozzle body;

(d) a hose for supplying said extinguishing agent to the other end of said tubular nozzle body;

(e) a coupling for connecting said hose to said other end of said tubular nozzle body;

(f) an abutment carried on the exterior of said tubular nozzle body adjacent the central portion of said tubular nozzle body;

(g) a manually movable slidable elongated tubular mass having an axial bore extending therethrough of a diameter slightly larger than the diameter of said tubular body concentrically carried on said tubular nozzle body between said abutment and said other end; and (h) a separate handle attached to said tubular nozzle body formed of "U" shaped members extending radially from said body, said handle being positioned on the opposite side of said abutment from said slidable mass whereby said fire extinquishing apparatus can be supported by said handle with one hand while the other hand of an operator can be used to manipulate said slidable mass, whereby by moving said slidable mass along said tubular nozzle body while maintaining said penetrating head in contact with said barrier the axial force imparted to said penetrating head upon said mass striking said abutment causes said head to penetrate said barrier for delivering said extinguishing agent into said structure.

* * * * *